United States Patent [19]

Mankowski

[11] Patent Number: 4,676,147

[45] Date of Patent: Jun. 30, 1987

[54] ROOF RIDGE VENTILATOR

[76] Inventor: John P. Mankowski, 26665 Meadowlark, Southfield, Mich. 48076

[21] Appl. No.: 756,054

[22] Filed: Jul. 17, 1985

[51] Int. Cl.[4] ..... F24F 7/02

[52] U.S. Cl. ..... 98/42.21

[58] Field of Search ..... 52/199; 98/42.21, 42.22, 98/42.2

[56] References Cited

U.S. PATENT DOCUMENTS

| | | | |
|---|---|---|---|
| 2,579,662 | 12/1951 | Gibson | 98/42.21 |
| 2,799,214 | 7/1957 | Rouse | 98/42.21 |
| 3,236,170 | 2/1966 | Meyer et al. | 98/42.21 |
| 3,481,263 | 12/1969 | Belden | 98/42.21 |
| 4,131,060 | 12/1978 | Caine | 98/119 X |
| 4,138,935 | 2/1979 | Vallée | 98/42.21 |
| 4,280,399 | 7/1981 | Cunning | 98/42.21 |
| 4,345,510 | 8/1982 | Sterett | 98/40.27 |
| 4,545,292 | 10/1985 | Inokawa et al. | 98/42.21 |

*Primary Examiner*—Harold Joyce

*Attorney, Agent, or Firm*—Brooks & Kushman

[57] ABSTRACT

A roof ridge ventilator (10) comprises a one piece cover member (12) including a pair of flaps (14) and a hinge (16) unitary with the flaps to permit pivotal movement therebetween in order to allow use of the ventilator on roof ridges of different angles, the cover member being designed to be placed underneath a standard cap shingle (20). A pair of vents (22) are located below the pair of cover member flaps (14), and each vent has openings (24) to permit air circulation through the roof ridge. Each vent (22) also has an interior baffle structure (26) that deflects the air flow to limit entry of foreign particles through the roof ridge. The ventilator easily accomplishes the necessary air flow while providing an attractive, nearly undetectable roof ridge ventilator.

15 Claims, 4 Drawing Figures

ROOF RIDGE VENTILATOR

TECHNICAL FIELD

This invention relates to a roof ridge ventilator.

BACKGROUND ART

Roof ridge ventilators vent hot air through the roof of a building to decrease the temperature within the building and allow for air circulation underneath the roof. Conventionally, roof ventilators have been unsightly, are placed on top of roof shingles, and have served as nesting places for birds, insects, and the like. Previous roof ventilator designs have been: of a substantial upwardly projecting height, as shown in Malott U.S. Pat. No. 4,045,928; difficult to install, as shown in Cunning U.S. Pat. No. 4,280,399; structured of many pieces, such as shown in Vallee U.S. Pat. No. 4,138,935 and Sells U.S. Pat. No. 3,949,657; or unable to adapt to various roof pitches, as shown in Vallee U.S. Pat. No. 4,138,935. Most roof ventilators are installed on top of the roof shingles and are thus conspicuous.

The previously mentioned Cunning patent discloses a flexible, one piece, corrugated, roof ridge ventilator having a plurality of longitudinally extending peaks and valleys with side walls extending therebetween. This corrugated ventilator includes upwardly and outwardly turned flanges extending continuously along its outer edges to prevent entry of moisture into the roof vent. As illustrated, the corrugated ventilator is installed with many nails to retain its corrugated shape.

DISCLOSURE OF INVENTION

An object of the present invention is to provide an improved roof ridge ventilator that has particular utility in the construction of residential and commercial buildings.

In carrying out the above object and other objects of the invention, the roof ridge ventilator has a one piece cover member of an elongated shape including a pair of flaps and a hinge unitary with the flaps and including a longitudinal groove therebetween to permit pivotal movement in order to allow use of the ventilator on roof ridges of different angles. This cover member has an upper surface over which cap shingles are secured, normally by nailing through the ventilator. A pair of vents are respectively located beneath the pair of cover member flaps. Each vent has openings to permit air circulation and also has an interior baffle structure that deflects the air flow to limit entry of foreign particles through the roof ridge.

Both the cover member and vents are preferably made from a suitable plastic. The most preferred plastic is polypropylene which emits bug repelling odors so that insects and bugs are discouraged from nesting or entering the roof through the ventilator.

The cover member of the ventilator has a lateral width substantially the same as the width of a standard cap shingle. When secured over the upper cover member surface, a standard cap shingle will also conform to the pitch of the roof.

A pair of outwardly and downwardly projecting, extensions are preferably attached along longitudinal outer edges of the cover member flaps and extend beyond the edges of the standard cap shingle. These extensions prevent water from entering the ventilator and provide a watershed to deflect water onto the shingles which will extend below the roof ridge ventilator.

Each vent of the ventilator preferably includes a longitudinally extending inner wall having vent openings. The interior baffle structure has longitudinally spaced outer support walls that extend vertically and also has a baffle located between the inner wall and the outer support walls. A bottom wall of the preferred vent construction has the inner wall and interior baffle structure projecting upwardly therefrom to the associated cover member flap. Suitable connections secure the vertical support walls of the vents to the cover member flaps.

The vertical support walls of the interior baffle structure prevent birds, insects, etc. from nesting within or entering the roof through the ventilator while still permitting sufficient circulating airflow through the roof ridge. The support walls are spaced sufficiently close to prevent birds from passing through the vent. The baffle of the interior baffle structure deflects the airflow to limit entry of foreign particles through the roof ridge. Thus the baffle prevents accumulation of seedlings, leaves, or the like which could block the circulating airflow through the vent.

The openings of the inner wall of each vent are substantially circular. These circular openings have a diametric dimension in the range from about 1/64 of an inch to 13/32 of an inch, preferably 3/32 of an inch, to provide an airflow of at least about 3 cubic feet per minute per one hundred cubic feet of attic space with a conventional roof. Nevertheless the openings are sufficiently small to prevent most foreign particles from passing through or clogging the vents.

Installation of the present invention is more easily accomplished than continuous roof ridge ventilators in the prior art because the ventilator as disclosed is self-supporting and may be placed over the ridge of the roof and then secured with a minimum of fasteners. In the preferred construction, the ventilator has a thickness from about ¼ inch to about 2 inches, between the bottom vent walls and the cover member flaps and is about five feet in length. When polypropylene is used, the cover member flaps and extensions as well as the walls and baffle of each vent have a thickness of about 0.08 of an inch. Installers may lay lengths of the ventilator end-to-end over the roof ridge, place the cap shingles over the ventilators, and secure both the shingles and the ventilators in a single operation with a minimum of nails or other fasteners.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
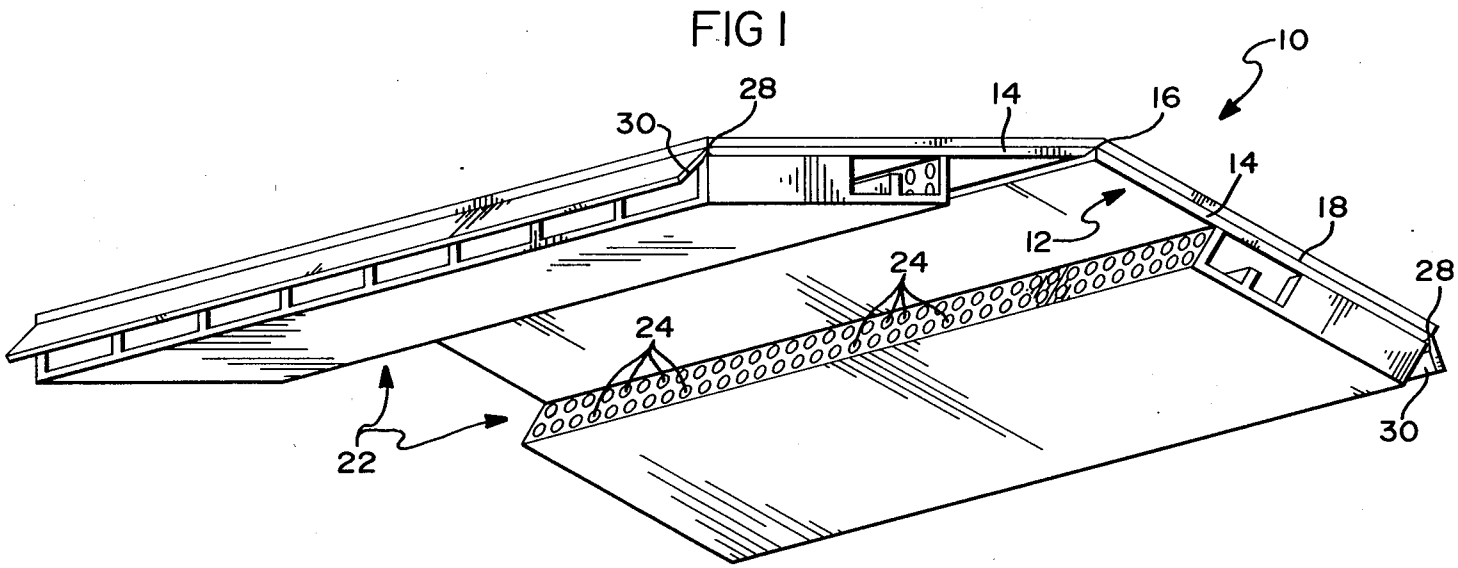
FIG. 1 is a perspective view of a roof ridge ventilator constructed in accordance with the present invention.

With reference to FIG. 1 of the drawings, A roof ridge ventilator constructed in accordance with the present invention is generally indicated by reference numeral 10 and has particular utility in the construction of residential and commercial buildings. Roof ridge ventilator 10 includes a one piece cover member 12 of an elongated shape including a pair of flaps 14 and a hinge 16 unitary with the flaps and including a longitudinal groove therebetween. This construction of the cover member 12 permits use of the ventilator 10 on roof ridges of different angles. Cover member 12 has a upper surface 18 over which cap shingles 20 are secured. This securement is normally provided by nailing through both the cap shingles 20 and the ventilator 10 and is hereinafter more fully described.

Figure 3:
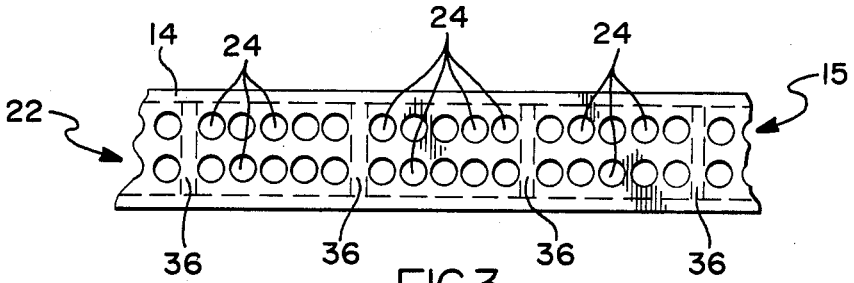
FIG. 3 is a partial view taken along the direction of line 3—3 in FIG. 2 to illustrate vent openings of the ventilator.
Figure 4:
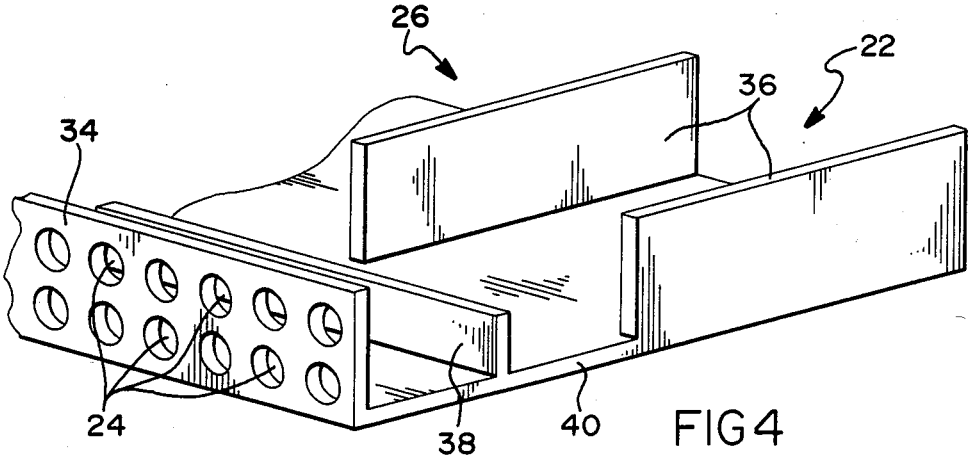
FIG. 4 is a perspective view illustrating the construction of vents of the ventilator.

Roof ridge ventilator 10 also includes a pair of vents 22 respectively located beneath the pair of cover member flaps 14. As hereinafter more fully described, each vent 22 has a plurality of vent openings 24 as illustrated in FIGS. 3 and 4 to permit air circulation through the ventilator. Each vent also has an interior baffle structure 26 as best illustrated in FIG. 4 to deflect the air flow through the ventilator and to limit the entry of foreign particles through the associated roof ridge as well as preventing birds and other animals from nesting within or passing through the ventilator.

Both the cover member 12 and the vents 22 of the ventilator are preferably made from a suitable plastic, although it is also possible to utilize a suitable metal such as aluminum or sheet steel. The most preferred plastic is polypropylene which emits bug repelling odors so that insects and bugs are discouraged from nesting or entering the roof through the ventilator. As disclosed, the cover member 12 is extruded from the polypropylene while the vents 22 are injection molded.

Figure 2:
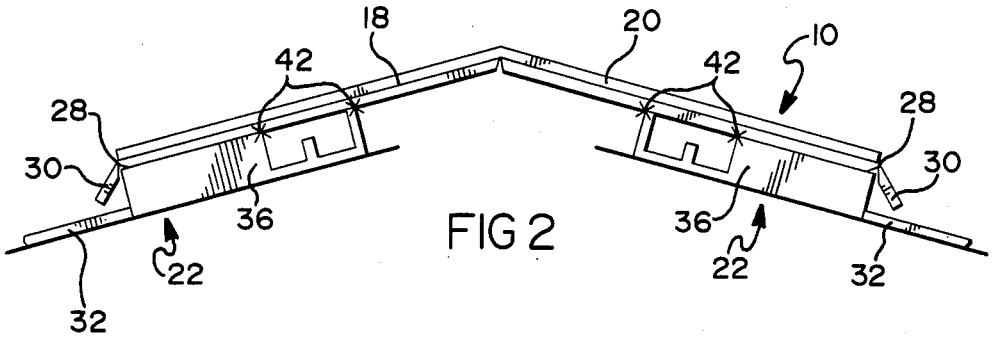
FIG. 2 is a view taken in section through a roof ridge on which the ventilator is installed.

Outer edges 28 of the cover member 12 are spaced from each other to provide the cover member with a lateral width that is substantially the same as the width of standard cap shingles 20 which, as previously mentioned, are placed over the ventilator upon installation as illustrated in FIG. 2. Upon such installation, the can shingle 20 will have the same pitch as the pitch of the roof and thereby provide the ventilator with an aesthetically appealing appearance.

A pair of outwardly and downwardly projecting extensions 30 are preferably intricately attached along the longitudinal outer edges 28 of the cover member 12. These extensions 30 project beyond the edges of the standard cap shingle 20 and prevent water from entering the ventilator 10 through the vents 22 as well as providing a water shed to deflect water onto the upper most roof shingles 32 over which the ventilator is installed.

Each vent 22 of the ventilator preferably includes a longitudinally extending inner wall 34 in which the vent openings 24 are provided at best illustrated in FIG. 4. The interior baffle structure 26 of each vent 22 preferably has longitudinally spaced outer support walls that extend vertically and are located remotely and downwardly from the inner wall 34 in the installed position. The interior baffle structure 26 also includes a baffle 38 located between the inner wall 34 and the outer support walls 36. A bottom wall 40 of the preferred vent construction has the inner wall 34 and the interior baffle structure projecting upwardly therefrom to the associated cover member flap 14. Suitable connections schematically illustrated at 42 secure the vertical support walls 36 of the vents 22 to the cover member flaps 14. These connections 42 can be made by projections of the support walls that are received within openings of the flaps and then heat deformed in a secured relationship or otherwise secured. Likewise, it is possible to adhesively secure the vents 22 to the cover member flaps 14 when the ventilator is made from plastic to which adhesive will secure.

The interior baffle structure 26 of each vent 22 is constructed to prevent birds, insects, etc. from nesting within or entering the roof through the ventilator while still permitting sufficient airflow through the roof ridge to provide adequate circulation. In the preferred embodiment disclosed, the support walls 36 are spaced at one inch intervals which is sufficiently close to prevent birds from passing through the vents 22 without being so close as to substantially restrict the circulating airflow. Also, the baffle 38 of the interior baffle structure 26 deflects the airflow to limit entry of foreign particles through the roof ridge, thus, the baffle 38 prevents accumulation of seedlings, leaves, or the like which could block the circulating airflow through the vent.

The openings 24 of the inner wall 34 of each vent are preferably substantially circular as illustrated in FIGS. 3 and 4. The circular openings 24 most preferably have a diametric dimension in the range from about 1/64 of an inch to 13/32 of an inch and are spaced with 10 openings along each inch of length of the inner wall. This opening spacing is provided with upper and lower rows of openings such that there are five openings in each row along each inch of length, as illustrated in FIG. 3. Such a construction provides at least about 3 cubic feet of circulating airflow per minute per 100 cubic feet of attic space when the ventilator 10 is utilized with a conventional roof. Furthermore, the size of the openings 24 are nevertheless sufficiently small to prevent most foreign particles from passing through or clogging the vents 22.

While the best mode for constructing the invention has been herein described in detail those familiar with the art to which this invention relates will recognize various alternative ways of carrying out the invention as defined by the following claims.

What is claimed is:

1. A roof ridge ventilator, comprising a one piece plastic cover member of an elongated shape including a pair of flaps and a hinge unitary with the flaps and including a longitudinal groove therebetween to permit pivotal movement of the flaps in order to allow use of the ventilator on roof ridges of different angles; said cover member having an upper surface over which cap shingles are secured and also having a downwardly facing lower surface; a pair of vents respectively secured to the lower surface of the cover member below the pair of flaps on opposite sides of the hinge groove; each vent having a longitudinally extending inner wall including openings to permit air circulation through the roof ridge; each vent also having an interior baffle structure including longitudinally spaced outer support walls that extend vertically to limit entry of foreign particles through the roof ridge; and the baffle structure of each vent further including a baffle located between the inner wall and the outer support walls to deflect air flow and cooperate with the inner and outer walls in limiting entry of foreign particles.

2. A roof ridge ventilator as in claim 1, wherein said ventilator is composed of polypropylene.

3. A roof ridge ventilator as in claim 1, wherein said cover member has a lateral width substantially the same as the width of a standard cap shingle.

4. A roof ridge ventilator, comprising a one piece plastic cover member of an elongated shape including a pair of flaps and a hinge unitary with the flaps and including a longitudinal groove therebetween to permit pivotal movement of the flaps in order to allow use of the ventilator on roof ridges of different angles; said cover member having an upper surface over which cap shingles are secured and also having a downwardly facing lower surface and having longitudinal outer edges spaced from each other on opposite sides of the hinge; a pair of outwardly and downwardly projecting extensions attached along the outer longitudinal edges of said cover member to prevent water from entering said ventilator; a pair of vents respectively secured to the lower surface of the cover member below the pair of flaps on opposite sides of the hinge groove; each vent having a longitudinally extending inner wall including openings to permit air circulation through the roof ridge; each vent also having an interior baffle structure including longitudinally spaced outer support walls that extend vertically which are located outwardly from the inner wall thereof toward the outer edge thereof to limit entry of foreign particles through the roof ridge; the baffle structure of each vent further including a baffle located between the inner wall and the outer support walls to deflect airflow and cooperate with the inner and outer walls in limiting entry of foreign particles; and each vent having a bottom wall from which the inner wall, the outer support walls of the interior baffle structure and the baffle located between the inner and outer walls project upwardly therefrom.

5. A roof ridge ventilator as in claim 4, which has a thickness between the bottom vent walls and upper cover member flaps of about $\frac{1}{4}$ inch to about 2 inches.

6. A roof ridge ventilator as in claim 4, which has a length of about 5 feet.

7. A roof ridge ventilator as in claim 4, wherein the width of said cover member between the outer edges is approximately the width of a standard cap shingle.

8. A roof ridge ventilator as in claim 4, wherein each extension projects outwardly and downwardly at an angle of approximately 45 degrees with respect to the associated cover member flap.

9. A roof ridge ventilator as in claim 4, wherein said unitary hinge is located centrally between the outer edges of the cover member flaps.

10. A roof ridge ventilator as in claim 4, wherein said ventilator is composed of polypropylene.

11. A roof ridge ventilator as in claim 10, wherein said polypropylene has a thickness of about 0.08 of an inch.

12. A roof ridge ventilator as in claim 4, wherein said vent openings are substantially circular having a diametric dimension in the range of about 1/64 to 13/32 of an inch.

13. A roof ridge ventilator as in claim 12, wherein said openings have a diametric dimension of about 3/32 of an inch.

14. A roof ridge ventilator as in claim 4, wherein the pair of vents are each of a one-piece construction separate from the other vent, and further including connections that secure each cover member flap and the associated one-piece vent.

15. A roof ridge ventilator as in claim 14, wherein the connections extend between the cover member flaps and the interior baffle structures.

* * * * *